US007878265B2

(12) United States Patent
Aoki

(10) Patent No.: US 7,878,265 B2
(45) Date of Patent: Feb. 1, 2011

(54) IMPACT POWER TOOL

(75) Inventor: Yonosuke Aoki, Anjo (JP)

(73) Assignee: Makita Corporation, Anjo-shi (JP)

( * ) Notice: Subject to any disclaimer, the term of this patent is extended or adjusted under 35 U.S.C. 154(b) by 51 days.

(21) Appl. No.: 12/010,501

(22) Filed: Jan. 25, 2008

(65) Prior Publication Data

US 2008/0210451 A1 Sep. 4, 2008

(30) Foreign Application Priority Data

Feb. 6, 2007 (JP) ..... 2007-027278
Feb. 6, 2007 (JP) ..... 2007-027285

(51) Int. Cl.
*B25D 17/24* (2006.01)

(52) U.S. Cl. ..... 173/210; 173/48; 173/109; 173/162.1

(58) Field of Classification Search ..... 173/201, 173/210, 48, 109, 212, 128, 162.1
See application file for complete search history.

(56) References Cited

U.S. PATENT DOCUMENTS 3,269,466 A * 8/1966 Mitchell ..... 173/93.6
3,797,586 A * 3/1974 Coyne et al. ..... 173/133
4,388,972 A 6/1983 Gidlund
5,192,420 A * 3/1993 Ohta et al. ..... 208/23
6,675,908 B1 * 1/2004 Frauhammer et al. ..... 173/48
6,763,879 B1 * 7/2004 Macheske et al. ..... 164/458
6,763,897 B2 * 7/2004 Hanke et al. ..... 173/210
6,938,705 B2 * 9/2005 Kikuchi ..... 173/201
2007/0017684 A1 1/2007 Stirm et al.

FOREIGN PATENT DOCUMENTS

CN 1247365 C 3/2006
EP 1 604 785 A2 12/2005
GB 618546 2/1949
GB 816351 7/1959
GB 1325499 8/1973
JP A 08-318342 12/1996

* cited by examiner

*Primary Examiner*—Rinaldi I Rada
*Assistant Examiner*—Nathaniel Chukwurah
(74) *Attorney, Agent, or Firm*—Oliff & Berridge, PLC

(57) ABSTRACT

It is an object of the invention to provide a technique for a reduction of an impact force cased by rebound of a tool bit after its striking movement in an impact power tool. The representative impact power tool includes a tool body, a hammer actuating member, a striker, a weight and an elastic element. A reaction force is transmitted from the hammer actuating member to the weight and the elastic element is elastically deformed when the weight moves ward by the reaction to absorb the reaction force. The invention is characterized in that the mass of the weight is set to about 40% or more of the mass of the striker.

9 Claims, 9 Drawing Sheets

Mass ratio( Weight 163/ Striker 143 is 0.79)

IMPACT POWER TOOL

BACKGROUND OF THE INVENTION

1. Field of the Invention

The present invention relates to an impact power tool for performing a linear hammering operation on a workpiece, and more particularly to a technique for cushioning a reaction force received from the workpiece during hammering operation.

2. Description of the Related Art

Japanese non-examined laid-open Patent Publication No. 8-318342 discloses a technique for cushioning an impact force caused by rebound of a tool bit after its striking movement in a hammer drill. In this known hammer drill, a rubber ring (cushion member) is disposed between the axial end surface of a cylinder on the body side and an intermediate element in the form of an impact bolt which strikes the tool bit When the tool bit receives a reaction force from the workpiece and rebounds after striking movement of the tool bit, the impact bolt collides with the rubber ring. At this time, the rubber ring cushions the impact force by elastic deformation. Further, the rubber ring also functions as a member for positioning the hammer drill body with respect to the workpiece during hammering operation. During the striking movement of the tool bit, the tip end of the tool bit is held pressed against the workpiece (the tool bit is held in its striking position) by application of the user's forward pressing force to the hammer drill body. The cylinder on the body side receives the pressing force via the rubber ring.

As described above, the known rubber ring has a function of cushioning the impact force caused by rebound of the tool bit and a function of positioning the hammer drill. It is advantageous for the rubber ring to be soft in order to absorb the rebound of the tool bit. On the contrary, it is advantageous for the rubber ring to be hard in order to improve the positioning accuracy. In other words, two different properties are demanded of the known rubber ring. It is difficult to provide the rubber ring with a hardness that satisfies the both functional requirements. In this point, further improvement is required.

SUMMARY OF THE INVENTION

Accordingly, it is an object of the present invention to provide a technique that contributes to reduction of an impact force caused by rebound of a tool bit after its striking movement in an impact power tool.

In order to solve the above-described problem, the representative impact power tool according to the present invention includes a tool body, a hammer actuating member and a striker. The hammer actuating member is disposed in a tip end region of the tool body and performs a predetermined hammering operation on a workpiece by reciprocating in its axial direction. The striker performs a striking movement on the hammer actuating member by reciprocating in the longitudinal direction of the tool body. The "predetermined hammering operation" in this invention includes not only a hammering operation in which the hammer actuating member performs only a linear striking movement, but a hammer drill operation in which it performs a linear striking movement and a rotation in the circumferential direction. The "hammer actuating member" in this invention typically comprises a tool bit and an impact bolt that transmits a striking force in the state of contact with the tool bit.

The impact power tool of this invention further includes a weight and an elastic element. When the hammer actuating member performs a hammering operation on the workpiece, a reaction force is transmitted from the hammer actuating member to the weight in a reaction force transmitting position in which the weight is placed in direct contact with the hammer actuating member or in which the weight is placed in contact with the hammer actuating member via an intervening member made of hard metal. When the weight is caused to move rearward on the reaction force transmitting position by the reaction force transmitted to the weight and pushes the elastic element, the elastic element elastically deforms and thereby absorbs the reaction force. Further, in a preferred aspect of the present invention, the mass of the weight is set to about 40% or more of the mass of the striker. The "weight" in this invention typically comprises a cylindrical member, but it may comprise a plurality of elements separated from each other in the circumferential direction. Further, the "elastic element" typically comprises a spring, but it may comprise a rubber.

During hammering operation, the hammer actuating member is caused to rebound by receiving the reaction force of the workpiece after striking movement. According to this invention, with the construction in which the reaction force is transmitted from the hammer actuating member to the weight in the reaction force transmitting position in which the weight is placed in direct contact with the hammer actuating member or in which the weight is placed in contact with the hammer actuating member via an intervening member made of hard metal, the reaction force is nearly 100% transmitted. In other words, the reaction force is transmitted by exchange of momentum between the hammer actuating member and the weight. By this transmission of the reaction force, the weight is caused to move rearward in the direction of action of the reaction force. The rearward moving weight elastically deforms the elastic element, and the reaction force of the weight is absorbed by such elastic deformation. Specifically, according to this invention, the reaction force caused by rebound of the hammer actuating member can be absorbed by the rearward movement of the weight and by the elastic deformation of the elastic element which is caused by the movement of the weight. As a result, vibration of the impact power tool can be reduced.

The hammering operation using the impact power tool is performed under loaded conditions in which the tip end of the hammer actuating member is pressed against the workpiece by the user's pressing force applied forward to the tool body (i.e. in the state in which the impact power tool is positioned with respect to the workpiece). At this time, the hammer actuating member is held in a position to be driven by the driving mechanism, or in a striking position in which the striker strikes the hammer actuating member. The "reaction force transmitting position" in this invention refers to a position in which the reaction force received from the workpiece by the hammer actuating member is transmitted from the hammer actuating member to the weight when the hammer actuating member is driven by the driving mechanism, whether the hammer actuating member is in direct contact with the weight or in contact with the weight via an intervening member. Therefore, the reaction force transmitting position generally coincides with the above-described striking position.

According to the invention, the mass of the weight is set about 40% or more of the mass of the striker. As a result, the peak acceleration generated by the reaction force of rebound when the striking movement is performed can be advantageously reduced.

As one aspect of the invention, high vibration reducing function is performed when the mass of the weight is set in the range of the lower limit of about 40% of the mass of the striker to the upper limit of about 200% of the mass of the striker. Particularly, when the mass of the weight is about 80% of the mass of the striker, the vibration reducing effect can be further enhanced. Further, when the mass of the weight is about 200% of the mass of the striker, the vibration reducing effect can be practically maximized. Further, this vibration reducing effect can also be maintained with the weight having a further increased mass over 200%. However, the mass of the weight may preferably be set to about 200% or below of the mass of the striker due to the balance between the mass ratio of the weight and the entire mass of the hammer drill.

As described above, during hammering operation by the hammer actuating member, the weight is caused to move rearward by the reaction force caused by rebound of the hammer actuating member. At this time, the elastic element elastically deforms and absorbs the reaction force transmitted to the weight. The weight is then returned by the restoring force of the elastic element to the reaction force transmitting position in which the reaction force was transmitted from the hammer actuating member to the weight. However, when the striker performs the next striking movement the hammer actuating member in a midway region by the time the weight is returned to the reaction force transmitting position after the weight is caused to move rearward from the reaction force transmitting position by receiving the reaction force, the weight and the elastic element do not function properly.

Having regard to this problem, according to one aspect of the invention, a resonance frequency defined under the assumption that the weight and the elastic element are models of a spring mass system may be set over half of the period of striking which is performed on the hammer actuating member by the striker. With such a construction, the weight can be returned to the initial reaction force transmitting position by the time the striker performs the next striking after the weight is caused to move rearward by receiving the reaction force from the hammer actuating member. Therefore, the weight and the elastic element can reliably function for each stroke of the striker. Thus, the vibration reducing performance can be increased.

Further, as one aspect of the invention, the elastic element comprises a coil spring, and a spring constant of the coil spring is set to satisfy that $k>\pi^2 mfo^2$, wherein the spring constant is taken as k, the pi is $\pi$, the mass of the weight is m, and the frequency of striking which is performed on the hammer actuating member by the striker is fo. By setting the spring constant k of the coil spring to such a value that satisfies the above-mentioned equation, an impact absorbing mechanism can be provided in which the resonance frequency defined under the assumption that the weight and the elastic element are models of a spring mass system is set over half of the period of striking which is performed on the hammer actuating member by the striker.

Further, as one aspect of the invention, a viscoelastic member may be disposed between the weight and the elastic element and serves to absorb a stress wave of the weight when the reaction force of the hammer actuating member is transmitted to the weight The viscoelastic member may typically comprise a rubber.

During hammering operation, a reaction force caused by rebound of the hammer actuating member is transmitted to the weight and produces a stress wave in the weight. With such construction, the stress wave produced in the weight can be absorbed by deformation of the viscoelastic member. Therefore, when the elastic element comprises a spring, the spring can be prevented from surging which may be caused by transmission of the stress wave to the spring. Thus, the spring can be protected.

According to the invention, a technique is provided which contributes to reduction of an impact force caused by rebound of a tool bit after its striking movement in an impact power tool. Other objects, features and advantages of the present invention will be readily understood after reading the following detailed description together with the accompanying drawings and the claims.

DETAILED DESCRIPTION OF THE INVENTION

Figure 1:
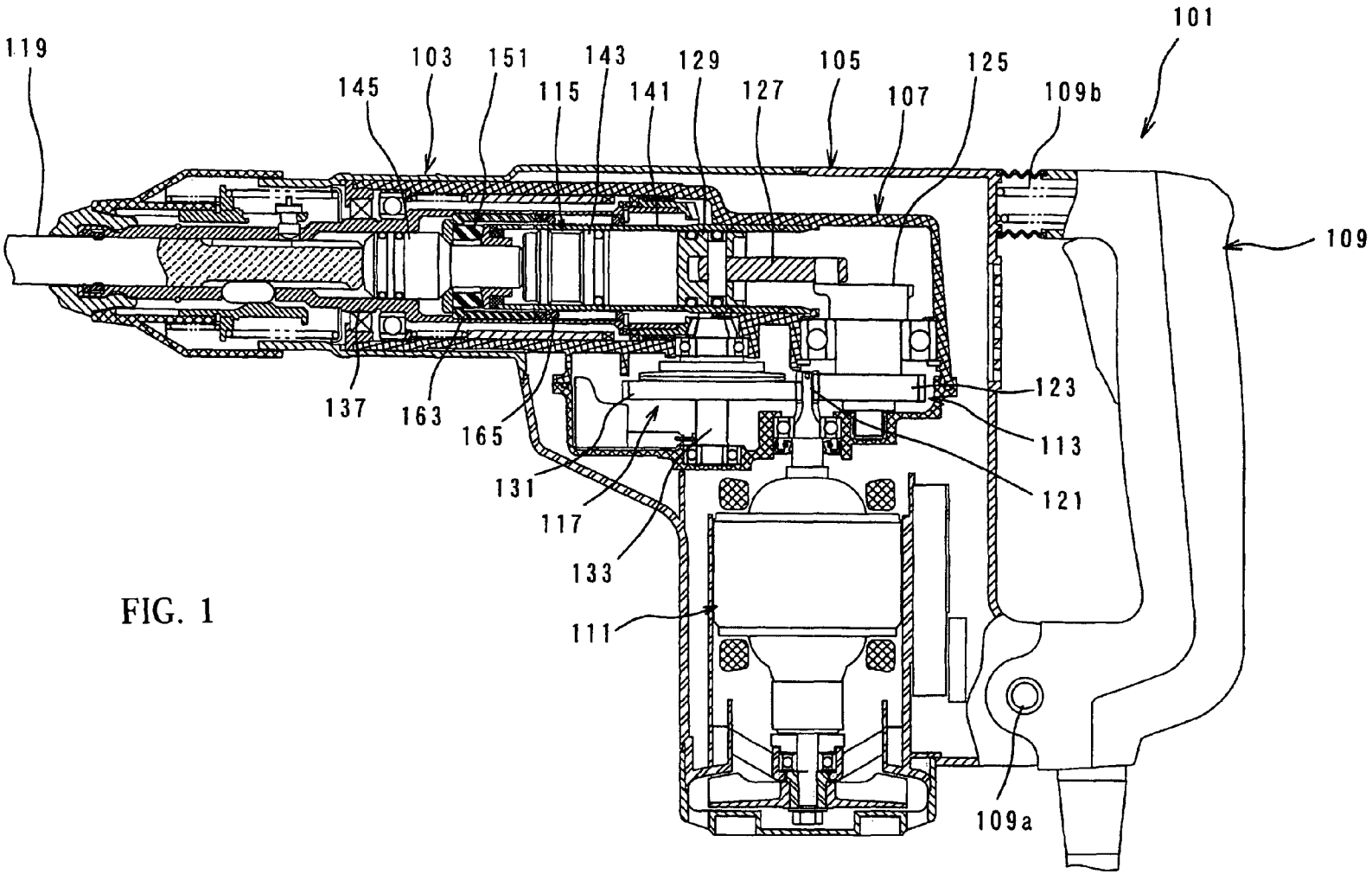
FIG. 1 is a sectional side view schematically showing an entire electric hammer drill according to an embodiment of this invention, under loaded conditions in which a hammer bit is pressed against a workpiece.

Each of the additional features and method steps disclosed above and below may be utilized separately or in conjunction with other features and method steps to provide and manufacture improved impact power tools and method for using such impact power tools and devices utilized therein. Representative examples of the present invention, which examples utilized many of these additional features and method steps in conjunction, will now be described in detail with reference to the drawing. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

An embodiment of the present invention is now described with reference to FIGS. 1 to 9. FIG. 1 is a sectional side view showing an entire electric hammer drill 101 as a representative embodiment of the impact power tool according to the present invention, under loaded conditions in which a hammer bit is pressed against a workpiece. As shown in FIG. 1, the hammer drill 101 of this embodiment includes a body 103, a hammer bit 119 detachably coupled to the tip end region (on the left side as viewed in FIG. 1) of the body 103 via a tool holder 137, and a handgrip 109 that is connected to the rear end region (on the right side as viewed in FIG. 1) of the body 103 and designed to be held by a user. The body 103 is a feature that corresponds to the "tool body" according to the present invention. The hammer bit 119 is held by the tool holder 137 such that it is allowed to reciprocate with respect to the tool holder 137 in its axial direction and prevented from rotating with respect to the tool holder 137 in its circumferential direction. In the present embodiment, for the sake of convenience of explanation, the side of the hammer bit 119 is taken as the front side and the side of the handgrip 109 as the rear side.

The body 103 includes a motor housing 105 that houses a driving motor 111, and a gear housing 107 that houses a driving mechanism in the form of a motion converting mechanism 113, a striking mechanism 115 and a power transmitting mechanism 117. The motion converting mechanism 113 is adapted to appropriately convert the rotating output of the driving motor 111 to linear motion and then to transmit to the striking mechanism 115. As a result, an impact force is generated in the axial direction of the hammer bit 119 via the striking mechanism 115. Further, the speed of the rotating output of the driving motor 111 is appropriately reduced by the power transmitting mechanism 117 and then transmitted to the hammer bit 119. As a result, the hammer bit 119 is caused to rotate in the circumferential direction. The handgrip 109 is generally U-shaped in side view, having a lower end and an upper end. The lower end of the handgrip 109 is rotatably connected to the rear end lower portion of the motor housing 105 via a pivot 109*a*, and the upper end is connected to the rear end upper portion of the motor housing 105 via an elastic spring 109*b* for absorbing vibration. Thus, the transmission of vibration from the body 103 to the handgrip 109 is reduced.

Figure 2:
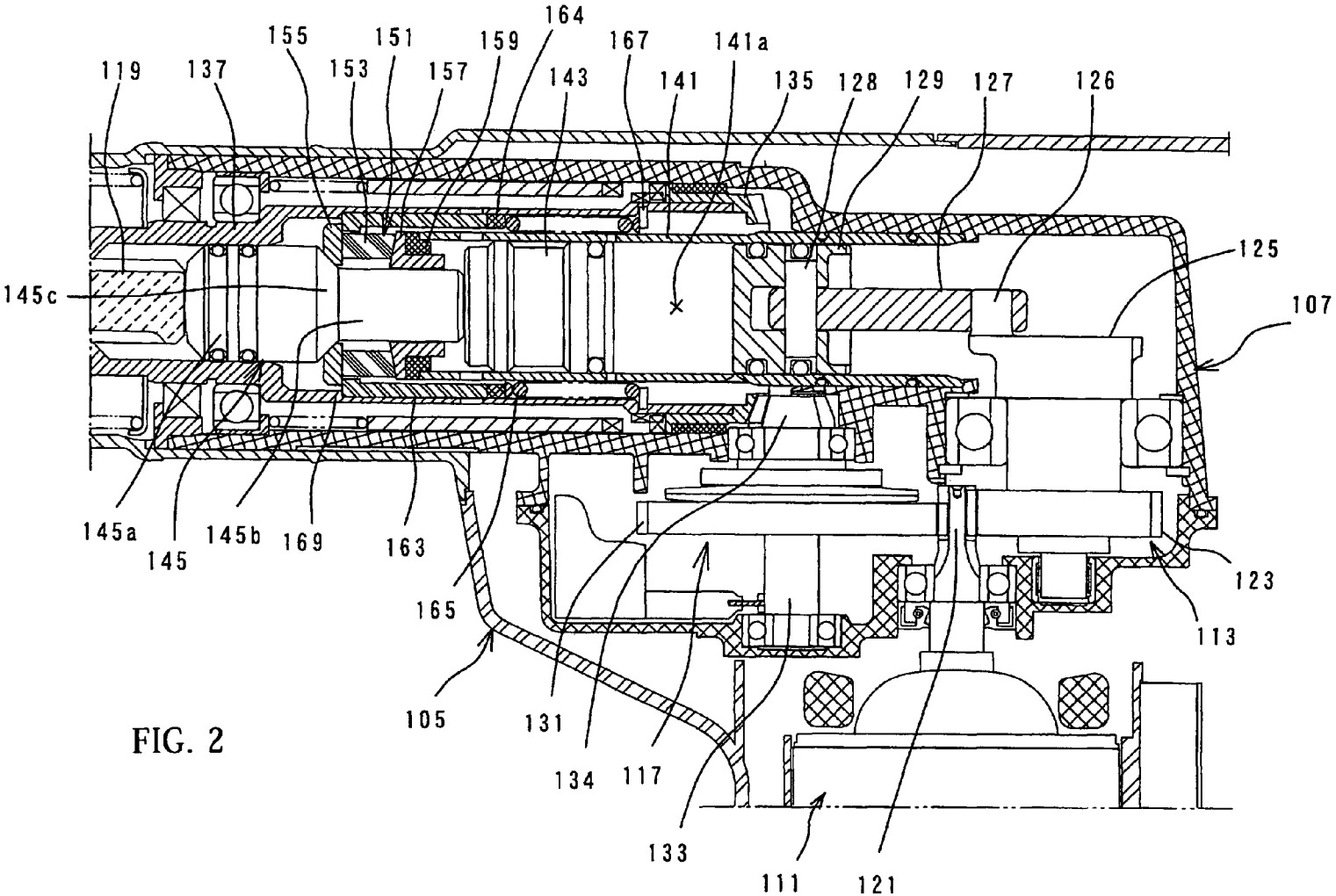
FIG. 2 is an enlarged sectional view showing an essential part of the hammer drill.

FIG. 2 is an enlarged sectional view showing an essential part of the hammer drill 101. The motion converting mechanism 113 includes a driving gear 121 that is rotated in a horizontal plane by the driving motor 111, a driven gear 123 that engages with the diving gear 121, a crank plate 125 that rotates together with the driven gear 123 in a horizontal plane, a crank arm 127 that is loosely connected at one end to the crank plate 125 via an eccentric shaft 126 in a position displaced a predetermined distance from the center of rotation of the crank plate 125, and a driving element in the form of a piston 129 mounted to the other end of the crank arm 127 via a connecting shaft 128. The crank plate 125, the crank arm 127 and the piston 129 form a crank mechanism The power transmitting mechanism 117 includes a driving gear 121 that is driven by the driving motor 111, a transmission gear 131 that engages with the driving gear 121, a transmission shaft 133 that is caused to rotate in a horizontal plane together with the transmission gear 131, a small bevel gear 134 mounted onto the transmission shaft 133, a large bevel gear 135 that engages with the small bevel gear 134, and a tool holder 137 that is caused to rotate together with the large bevel gear 135 in a vertical plane. The hammer drill 101 can be switched between hammer mode and hammer drill mode. In the hammering mode, the hammer drill 101 performs a hammering operation on a workpiece by applying only a striking force to the hammer bit 119 in its axial direction. In the hammer drill mode, the hammer drill 101 performs a hammer drill operation on a workpiece by applying a striking force in the axial direction and a rotating force in the circumferential direction to the hammer bit 119. This construction of the hammer drill 101 is not directly related to the present invention and therefore will not be described in further detail. The workpiece is not shown here in the drawings.

The striking mechanism 115 includes a striker 143 that is slidably disposed together with the piston 129 within the bore of the cylinder 141. The striker 143 is driven via the action of an air spring of an air chamber 141*a* of the cylinder 141 which is caused by sliding movement of the piston 129. The striker 143 then collides with (strikes) an intermediate element in the form of an impact bolt 145 that is slidably disposed within the tool holder 137 and transmits the striking force to the hammer bit 119 via the impact bolt 145. The impact bolt 145 and the hammer bit 119 are features that correspond to the "hammer actuating member" according to this invention. The impact bolt 145 includes a large-diameter portion 145*a*, a small-diameter portion 145*b* and a tapered portion 145*c*. The large-diameter portion 145*a* is fitted in close contact with the inner surface of the tool holder 137, while a predetermined extent of space is defined between a small-diameter portion 145*b* and the inner peripheral surface of the tool holder 137. The tapered portion 145*c* is formed in the boundary region between the both diameter portions 145*a* and 145*b*. The impact bolt 145 is disposed within the tool holder 137 in such an orientation that the large-diameter portion 145*a* is on the front side and the small diameter portion 145*b* is on the rear side.

The hammer drill 101 includes a positioning member 115 that positions the body 103 with respect to the workpiece by contact with the impact bolt 145 when the impact bolt 145 is pushed rearward (toward the piston 129) together with the hammer bit 119 under loaded conditions in which the hammer bit 119 is pressed against the workpiece by the user's pressing force applied forward to the body 103. The positioning member 151 is a unit part including a rubber ring 153, a front-side hard metal washer 155 joined to the axially front surface of the rubber ring 153, and a rear-side hard metal washer 157 joined to the axially rear surface of the rubber ring 153. The positioning member 151 is loosely fitted onto the small-diameter portion 145*b* of the impact bolt 145.

When the impact bolt 145 is pushed rearward, the tapered portion 145*c* of the impact bolt 145 contacts the front metal washer 155 of the positioning member 151 and the rear metal washer 157 contacts the front end of the cylinder 141. Thus, the rubber ring 153 of the positioning member 151 elastically connects the impact bolt 145 to the cylinder 141 that is fixedly mounted to the gear housing 107. The front metal washer 155 has a tapered bore. When the impact bolt 145 is pushed rearward, the tapered surface of the front metal washer 155 closely contacts the tapered portion 145*c* of the impact bolt 145. Further, the rear metal washer 157 has a generally hat-like sectional shape, having a cylindrical portion of a predetermined length which is fitted onto the small-diameter portion 145*b* of the impact bolt 145 and a flange that extends radially outward from the cylindrical portion. The rear surface of the flange is in contact with the axial front end of the cylinder 141 via a spacer 159.

In order to absorb the impact force (reaction force) that is caused by rebound of the hammer bit 119 after the striking movement of the hammer bit 119 during hammering operation on the workpiece, the hammer drill 101 according to this embodiment includes a hard metal cylindrical weight 163 that contacts the impact bolt 145 via the front metal washer 155 and a coil spring 165 that normally biases the cylindrical weight 163 toward the impact bolt 145 (forward). The cylindrical weight 163 and the coil spring 165 form an impact absorbing mechanism which is also referred to as an impact damper. The cylindrical weight 163, the coil spring 165 and the front metal washer 155 are features that correspond to the "weight", the "elastic element" and the "intervening member", respectively, according to this invention. Further, a rubber ring 164 is disposed between the cylindrical weight 163 and the coil spring 165 and serves to absorb a stress wave of the cylindrical weight 163. The rubber ring 164 is a feature that corresponds to the "viscoelastic member" according to this invention.

The cylindrical weight 163 is disposed between the outer surface of the positioning member 151 and an inner surface of the tool holder 137 and can move in the axial direction of the hammer bit. The movement of the weight 163 is guided along the inner surface of the tool holder 137. Specifically, the cylindrical weight 163 and the positioning member 151 are arranged in parallel in the radial direction and in the same position on the axis of the hammer bit 119. The cylindrical weight 163 extends further rearward from the outer peripheral region of the positioning member 151 to the outer front region of the cylinder 141. The rubber ring 164 is disposed on the rear end of the weight 163, and the coil spring 165 is elastically disposed between the rubber ring 164 and the tool holder 137 under a predetermined initial load. Thus, the cylindrical weight 163 is biased forward and its front end is normally in contact with a control member in the form of a stepped position control stopper 169 formed in the tool holder 137, so that the weight 163 is prevented from moving forward beyond its striking position. In other words, the biasing force (elastic force) of the coil spring 165 that biases the weight 163 forward is controlled to be prevented from substantially acting forward beyond the striking position of the weight 163. The striking position here refers to a position in which the striker 143 collides with (strikes) the impact bolt 145. This striking position coincides with a position in which the reaction force from the impact bolt 145 is transmitted to the weight 163. This striking position is a feature that corresponds to the "reaction force transmitting position" according to this invention.

Under loaded conditions in which the impact bolt 145 is pushed rearward together with the hammer bit 119, the axial front end of the cylindrical weight 163 is in surface contact with the radially outward portion of the rear surface of the front metal washer 155 of the positioning member 151. Specifically, the cylindrical weight 163 is in contact with the impact bolt 145 via the front metal washer 155. Therefore, when the hammer bit 119 and the impact bolt 145 are caused to rebound by receiving a reaction force from the workpiece after striking movement, the reaction force from the impact bolt 145 is transmitted to the cylindrical weight 163 which is in contact with the impact bolt 145 via the front metal washer 155. The front metal washer 155 forms a reaction force transmitting member and has a larger diameter than the outside diameter of the rubber ring 153. Thus, the axial front end of the cylindrical weight 163 is in contact with an outer region of the front metal washer 155 outward of the outer surface of the rubber ring 153. The rubber ring 164 disposed between the cylindrical weight 163 and the coil spring 165 elastically deforms by a stress wave transmitted from the impact bolt 145 to the cylindrical weight 163. Thus, the rubber ring 164 absorbs the stress wave and prevents transmission of the stress wave to the coil spring 165. Specifically, the rubber ring 164 mainly serves as a member for absorbing a stress wave. When the cylindrical weight 163 is moved rearward by receiving a reaction form from the impact bolt 145, the coil spring 165 is pushed via the rubber ring 164 by the cylindrical weight 163. As a result, the coil spring 165 elastically deforms and absorbs the reaction force. One axial end of the coil spring 165 is held in contact with the axial rear end surface of the cylindrical weight 163 and the other axial end is in contact with a spring receiving ring 167 fixed to the tool holder 137.

Operation of the hammer drill 101 constructed as described above will now be explained When the driving motor 111 (shown in FIG. 1) is driven, the rotating output of the driving motor 111 causes the driving gear 121 to rotate in the horizontal plane. When the driving gear 121 rotate, the crank plate 125 revolves in the horizontal plane via the driven gear 123 that engages with the driving gear 121. Then, the piston 129 slidingly reciprocates within the cylinder 141 via the crank arm 127. The striker 143 reciprocates within the cylinder 141 and collides with (strikes) the impact bolt 145 by the action of the air spring function within the cylinder 141 as a result of the sliding movement of the piston 129. The kinetic energy of the striker 143 which is caused by the collision with the impact bolt 145 is transmitted to the hammer bit 119. Thus, the hammer bit 119 performs a striking movement in its axial direction, and the hammering operation is performed on a work-piece.

When the hammer drill 101 is driven in hammer drill mode, the driving gear 121 is caused to rotate by the rotating output of the driving motor 111, and the transmission gear 131 that engages with the driving gear 121 is caused to rotate together with the transmission shaft 133 and the small bevel gear 134 in a horizontal plane. The large bevel gear 135 that engages with the small bevel gear 134 is then caused to rotate in a vertical plane, which in turn causes the tool holder 137 and the hammer bit 119 held by the tool holder 137 to rotate together with the large bevel gear 135. Thus, in the hammer drill mode, the hammer bit 119 performs a striking movement in the axial direction and a rotary movement in the circumferential direction, so that the hammer drill operation is performed on the work-piece.

Figure 3:
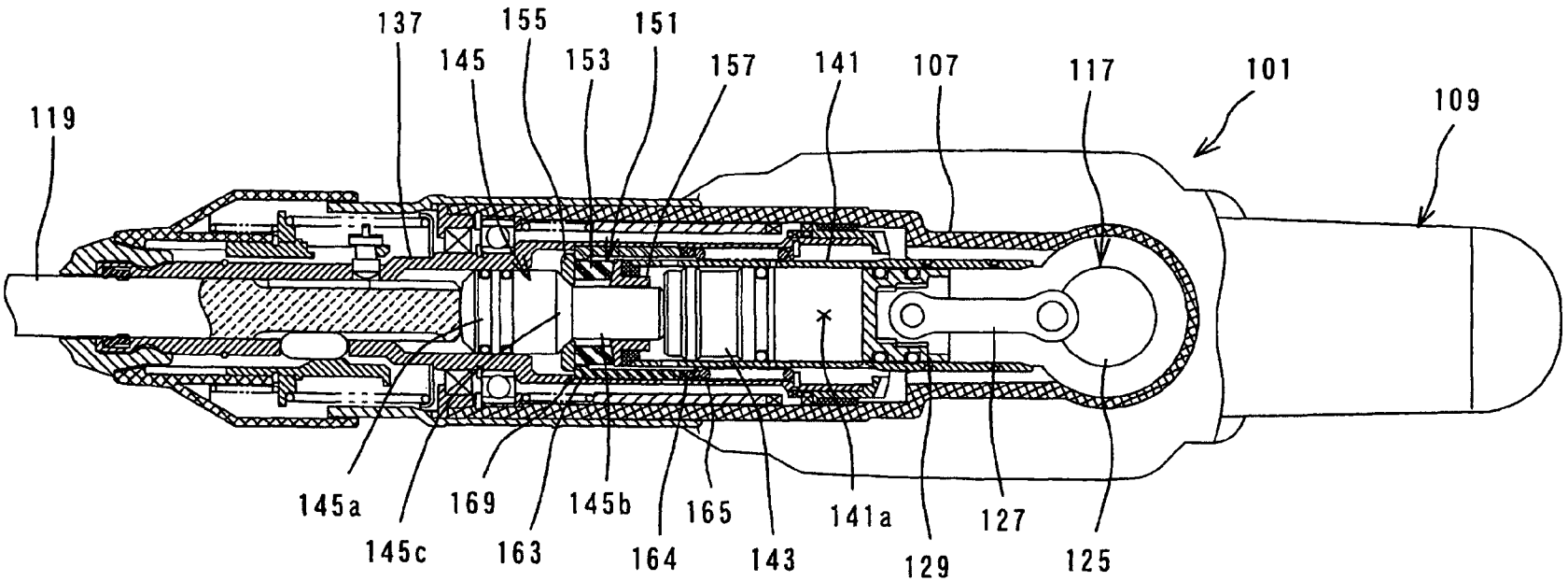
FIG. 3 is a sectional plan view showing the hammer drill under loaded conditions in which the hammer bit is pressed against the workpiece.

The above described operation is performed in the state in which the hammer bit 119 is pressed against the workpiece and in which the hammer bit 119 and the tool holder 137 are pushed rearward as shown in FIGS. 1 to 3. The impact bolt 145 is pushed rearward when the tool holder 137 is pushed rearward. The impact bolt 145 then contacts the front metal washer 155 of the positioning member 151 and the rear metal washer 157 contacts the front end of the cylinder 141. Specifically, the cylinder 141 on the body 103 side receives the force of pushing in the hammer bit 119, so that the body 103 is positioned with respect to the workpiece. In this state, a hammering operation or a hammer drill operation is performed. At this time, as described above, the front end surface of the cylindrical weight 163 is held in contact with the rear surface of the front metal washer 155 of the positioning member 151.

Figure 4:
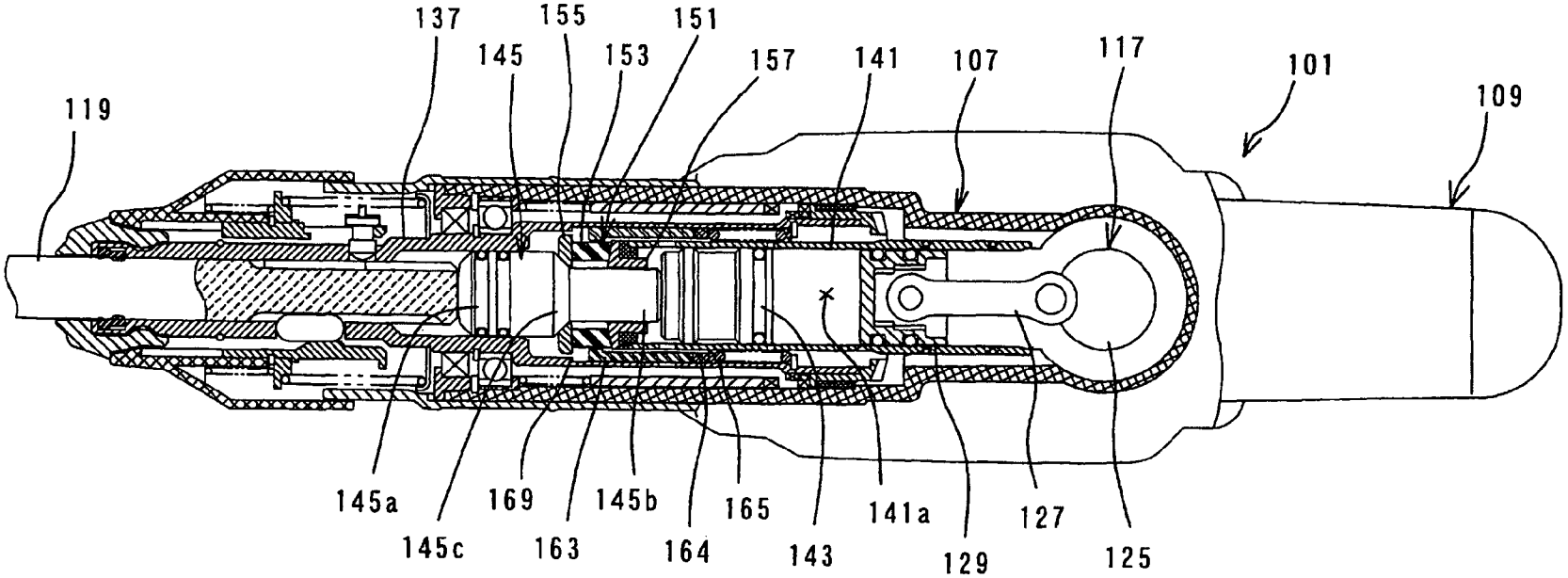
FIG. 4 is a sectional plan view showing the hammer drill during operation of a weight and a coil spring.

After striking movement of the hammer bit 119 upon the workpiece, the hammer bit 119 is caused to rebound by the reaction force from the workpiece. This rebound causes the impact bolt 145 to be acted upon by a rearward reaction force. At this time, the cylindrical weight 163 is in contact with the impact bolt 145 via the front metal washer 155 of the positioning member 151. Therefore, in this state of contact via the front metal washer 155, the reaction force of the impact bolt 145 is transmitted to the cylindrical weight 163. In other words, momentum is exchanged between the impact bolt 145 and the cylindrical weight 163. By such transmission of the reaction force, the impact bolt 145 is held substantially at rest in the striking position, while the cylindrical weight 163 is caused to move rearward in the direction of action of the reaction force. As shown in FIG. 4, the rearward moving cylindrical weight 163 elastically deforms the coil spring 165, and the reaction force of the weight 163 is absorbed by such elastic deformation.

At this time, the reaction force of the impact bolt 145 also acts upon the rubber ring 153 which is kept in contact with the impact bolt 145 via the front metal washer 155. Generally, the transmission rate of a force of one object is raised according to the Young's modulus of the other object placed in contact with the one object. According to this embodiment the cylindrical weight 163 of the impact damper 161 is made of hard metal and has high Young's modulus, while the rubber ring 153 made of rubber has low Young's modulus. Therefore, most of the reaction force of the impact bolt 145 is transmitted to the cylindrical weight 163 which has high Young's modulus and which is placed in contact with the metal impact bolt 145 via the hard front metal washer 155. Thus, the impact force caused by rebound of the hammer bit 119 and the impact bolt 145 can be efficiently absorbed by the rearward movement of the cylindrical weight 163 and by the elastic deformation of the coil spring 165 which is caused by the movement of the cylindrical weight 163. As a result, vibration of the hammer drill 101 can be reduced. At this time, the rubber ring 164 disposed between the cylindrical weight 163 and the coil spring 165 elastically deforms and thereby absorbs a stress wave transmitted from the impact bolt 145 to the cylindrical weight 163. Thus, the rubber ring 164 prevents transmission of the stress wave of the cylindrical weight 163 to the coil spring 165. As a result, the rubber ring 164 can prevent the coil spring 165 from surging and can protect it.

Thus, according to this embodiment, most of the reaction force that the hammer bit 119 and the impact bolt 145 receive from the workpiece after the striking movement is transmitted from the impact bolt 145 to the cylindrical weight 163. The impact bolt 145 is placed substantially at rest as viewed from the striking position. Therefore, only a small reaction force acts upon the rubber ring 153. Accordingly, only a slight amount of elastic deformation is caused in the rubber ring 153 by such reaction force, and a subsequent repulsion is also reduced. Further, the reaction force of the impact bolt 145 can be absorbed by the impact damper 161 which includes the cylindrical weight 163 and the coil spring 165. Therefore, the rubber ring 153 can be made hard. As a result, such rubber ring 153 can provide correct positioning of the body 103 with respect to the workpiece.

Further, in this embodiment, the stopper 169 controls the biasing force of the coil spring 165 such that the biasing force is prevented from substantially acting forward beyond the striking position. Therefore, during striking movement, when the user applies a pressing force forward to the body 103 to hold the hammer bit 119 and the impact bolt 145 in the striking position, even with a provision of the coil spring 165 for absorbing the reaction force, unnecessary force for holding the hammer bit 119 and the impact bolt 145 is not required. Unlike the construction, such as an idle driving prevention mechanism, in which a forward spring force normally acts upon the hammer bit 119 and the impact bolt 145 during striking movement, an efficient mechanism can be realized in which the adverse effect of the elastic force for absorbing a reaction force can be reduced.

Further, according to this embodiment, the forward position of the cylindrical weight 163 is mechanically controlled by the stopper 169. Thus, in this state in which the biasing force of the coil spring 165 is applied to the cylindrical weight 163, the cylindrical weight 163 is controlled to be prevented from moving beyond the striking position. Therefore, the condition settings for absorption of the reaction force, including the settings of the biasing force of the coil spring 165 or the weight of the cylindrical weight 163, can be facilitated.

Further, according to this embodiment, the reaction force from the workpiece is transmitted to the cylindrical weight 163 via the hammer bit 119 and the impact bolt 145. Thus, the reaction force from the workpiece can be transmitted in a concentrated manner to the cylindrical weight 163 without being scattered midway on the transmission path. As a result, the efficiency of transmission of the reaction force to the cylindrical weight 163 is increased, so that the impact absorbing function can be enhanced.

Further, in this embodiment, the cylindrical weight 163 and the positioning member 151 are arranged in parallel in the radial direction and in the same position on the axis of the hammer bit 119. Thus, an effective configuration for space savings can be realized. Further, the impact bolt 145 contacts the cylindrical weight 163 and the rubber ring 153 via a common hard metal sheet or the front metal washer 155. Therefore, the reaction force of the impact bolt 145 can be transmitted from one point to two members via a common member, that is, from the impact bolt 145 to the cylindrical weight 163 and the rubber ring 153 via the front metal washer 155. Further, the structure can be simplified.

Inventor conducted an impact test on the hammer drill 101 having the cylindrical weight (hereinafter referred to simply as "weight") 163 and the coil spring 165 in order to verify the relationship between the mass of the weight 163 and the vibration reducing effect, assuming that the mass of the weight 163 affects the reaction force absorbing effect or the vibration reducing effect. The impact test was conducted under the conditions in which the mass of the testing device is 5.85 kg, the pressing force of the testing device is 100N, the mass of the striker is 140 g, the speed of the striker is 9.65 m/s (average), the drill diameter is $\phi$20, and the low-pass filter is 1 kHz. Further, a plurality of weights 163 varying in mass in the range of 20 to 560 g were used in the impact test. The impact test was conducted several times for each weight 163 having a different mass.

Figure 5:
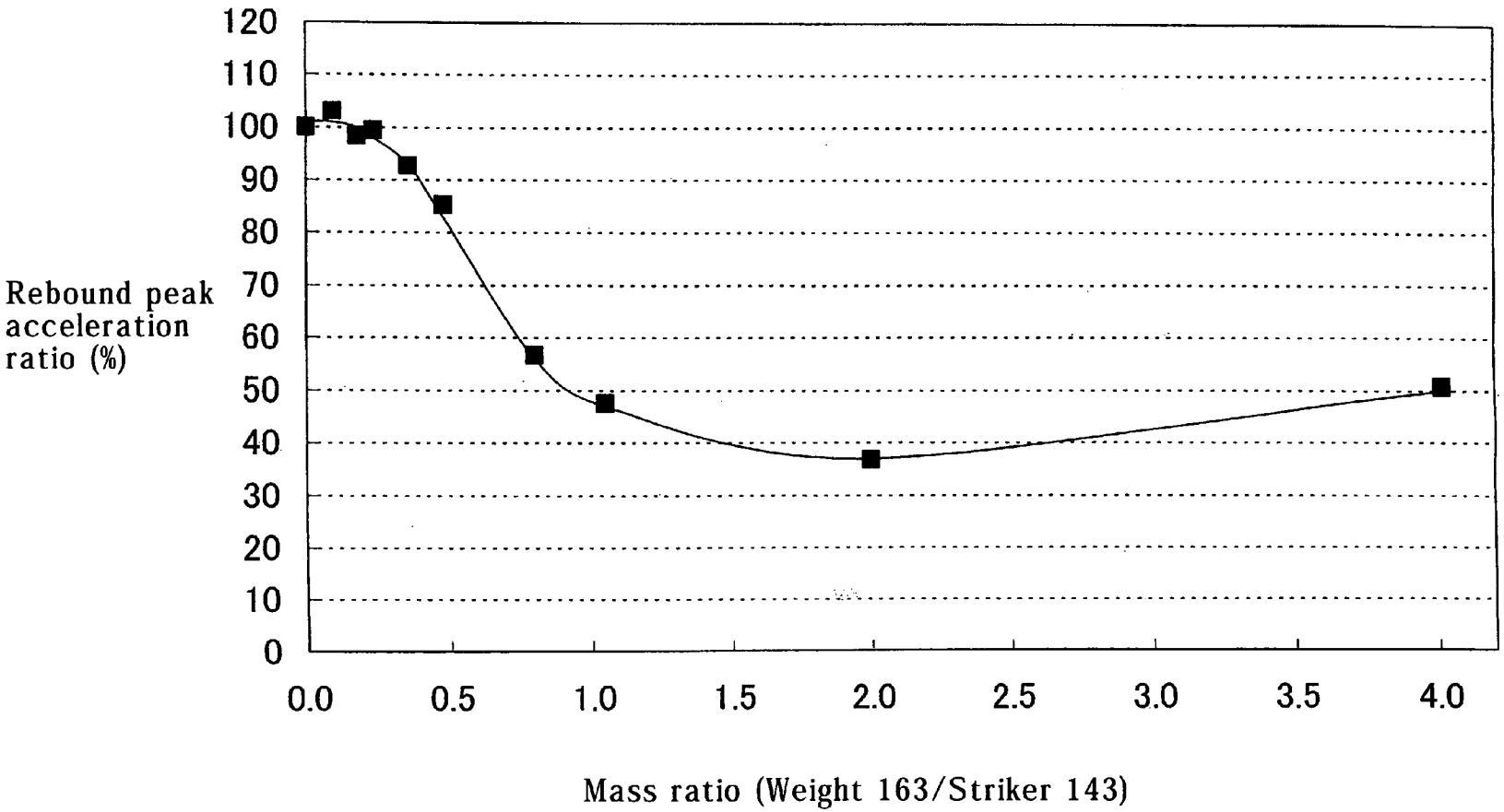
FIG. 5 is a graph showing the change of rebound acceleration (reaction force) with respect to the mass of the weight.

FIG. 5 shows the test results. FIG. 5 shows the change of rebound acceleration (reaction force) with respect to the mass of the weight 163. The abscissa indicates the mass ratio of the weight 163 to the striker 143, and the ordinate indicates the rebound peak acceleration ratio which is taken as 100% in the absence of the weight 163 and the coil spring 165. The test results showed that the peak acceleration by the reaction force of rebound during striking is reduced about 10% when the mass ratio of the weight 163 to the striker 143 is about 0.4. Further, the peak acceleration by the reaction force of rebound during striking is reduced about 50% when the mass ratio of the weight 163 to the striker 143 is about 0.8. Further, it was also shown that when the mass ratio of the weight 163 to the striker 143 is about 2.0, the peak acceleration by the reaction force of rebound during striking is reduced about 60% and a higher vibration reducing effect can be obtained. In this test, it was also shown that, when the mass ratio exceeds such a value that can obtain the higher vibration reducing effect, the peak acceleration does not substantially charge and the higher vibration reducing effect can be maintained.

Figure 6:
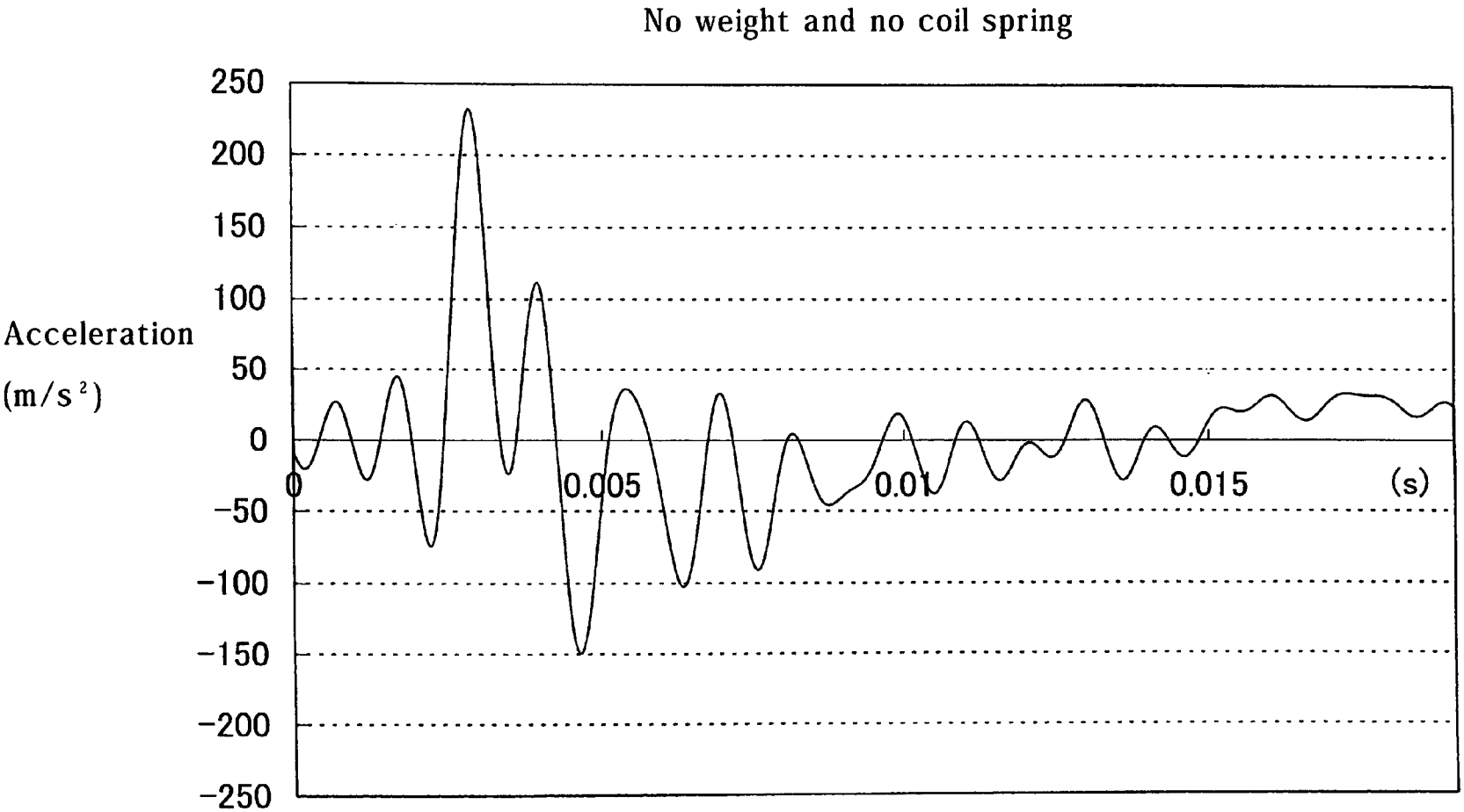
FIG. 6 shows the acceleration wave form in the absence of the weight and the coil spring.
Figure 7:
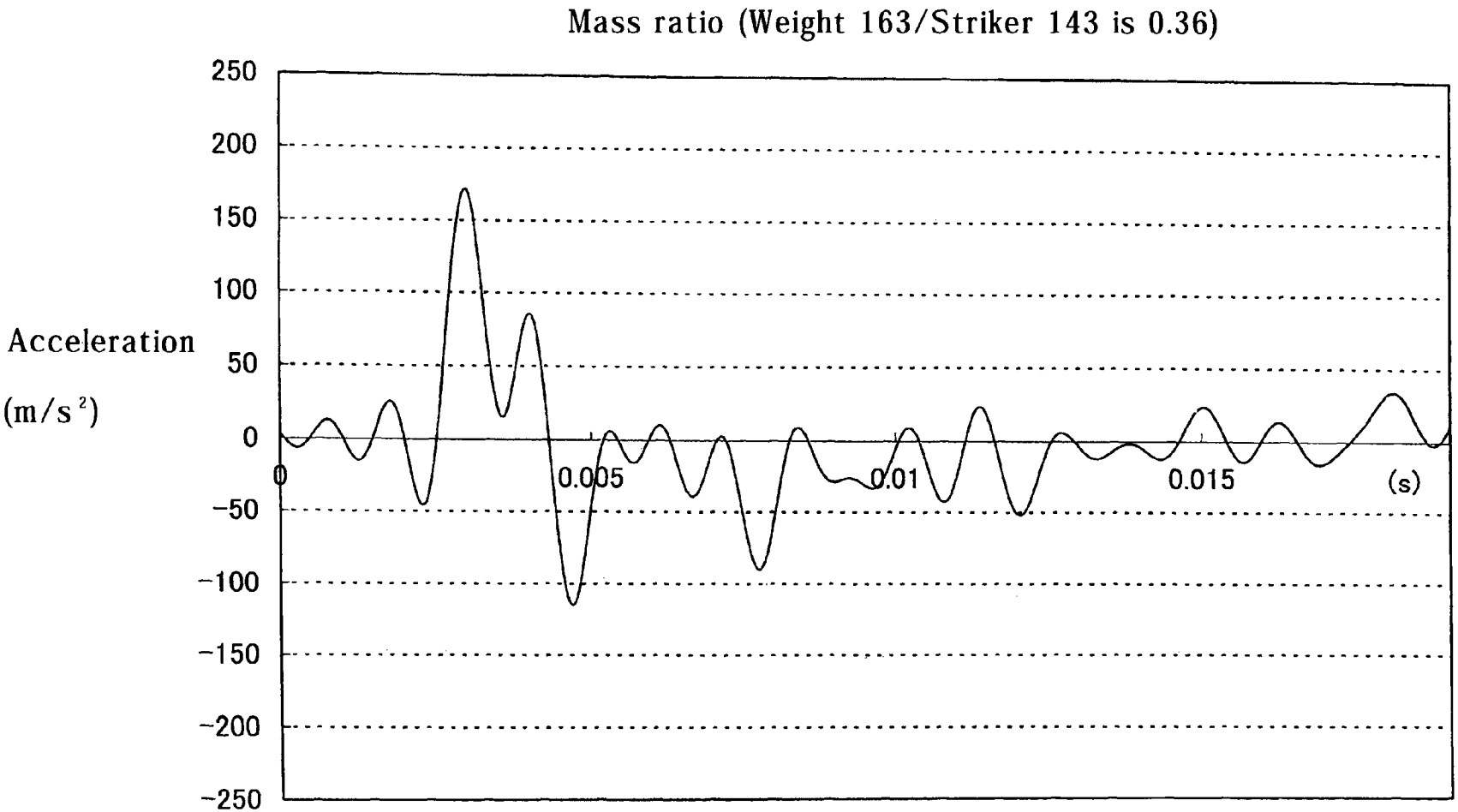
FIG. 7 shows the acceleration wave form when the mass of the weight is 50 g (the mass ratio of the weight to the striker is 0.36).
Figure 8:
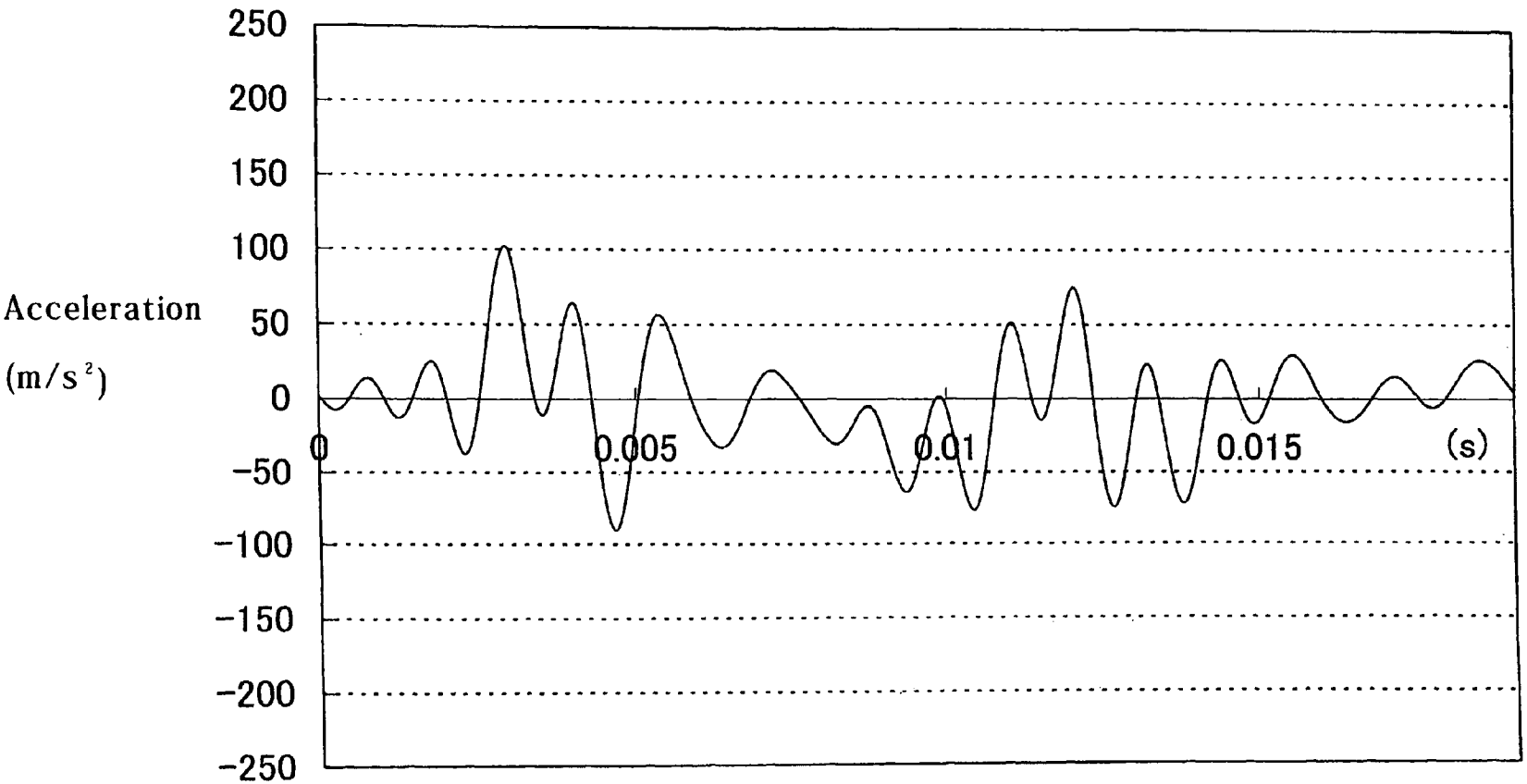
FIG. 8 shows the acceleration wave form when the mass of the weight is 110 g (the mass ratio of the weight to the striker is 0.79).
Figure 9:
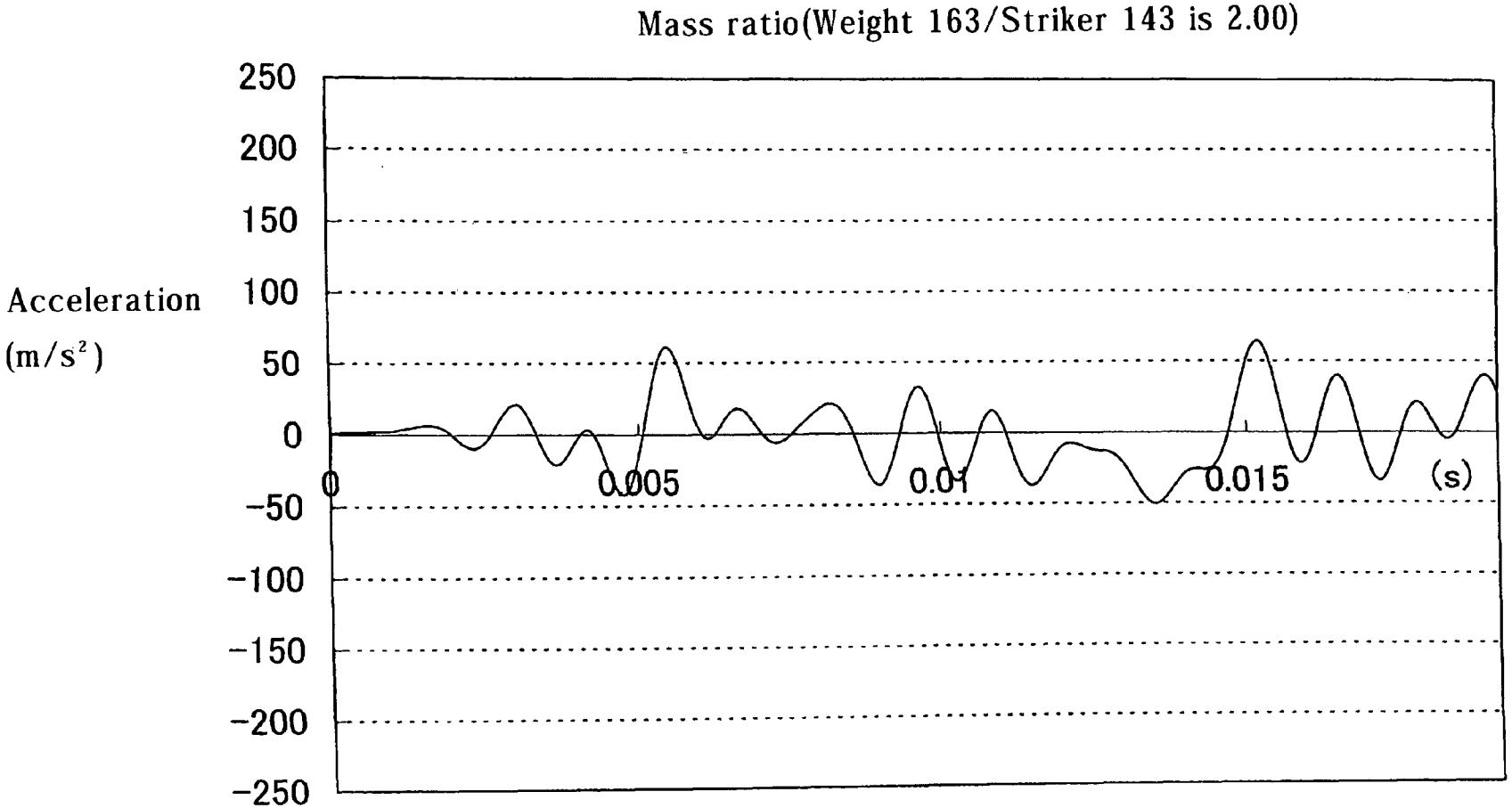
FIG. 9 shows the acceleration wave form when the mass of the weight is 280 g (the mass ratio of the weight to the striker is 2.0).

FIGS. 6 to 9 show the specific test results for verifying the vibration reducing effect from the mass ratio of the weight 163 and the peak acceleration as described above. FIGS. 6 to 9 show acceleration wave forms by mass ratio of the weight 163. Specifically, FIG. 6 shows the acceleration wave form in the absence of the weight 163 and the coil spring 165. FIG. 7 shows the acceleration wave form when the mass of the weight 163 is 50 g (the mass ratio of the weight 163 to the striker 143 is 0.36). FIG. 8 shows the acceleration wave form when the mass of the weight 163 is 110 g (the mass ratio of the weight 163 to the striker 143 is 0.79). FIG. 9 shows the acceleration wave form when the mass of the weight 163 is 280 g (the mass ratio of the weight 163 to the striker 143 is 2.0).

According to the test results, when the mass ratio of the weight 163 is 0 in the absence of the weight 163 and the coil spring 165, as shown in FIG. 6, the acceleration is as high as about 240 $m/s^2$. When the mass ratio is 0.36, as shown in FIG. 7, the acceleration is reduced to about 170 $m/s^2$. Further, when the mass ratio is 0.79, as shown in FIG. 8, the acceleration is reduced to about 100 $m/s^2$. Further, when the mass ratio is 2.0, as shown in FIG. 9, the acceleration is reduced to about 60 $m/s^2$.

Having regard to the above-described, a high vibration reducing function can be performed when the mass of the weight 163 is set in the range of the lower limit of about 400% of the mass of the striker 143 to the upper limit of about 200% of the mass of the striker 143. Particularly, when the mass of the weight 163 is about 80% of the mass of the striker 143, the vibration reducing effect can be further enhanced. Further, when the mass of the weight 163 is about 200% of the mass of the striker 143, the vibration reducing effect can be practically maximized. Further, this vibration reducing effect can also be maintained with the weight 163 having a further increased mass. However, it was also found to be practically preferable that the mass of the weight 163 is about 200% or below of the mass of the striker 143 due to the balance between the mass ratio of the weight and the entire mass of the hammer drill 101.

In hammering operation by the hammer bit 119, as described above, the weight 163 is caused to move rearward by the reaction force caused by rebound of the impact bolt 145. At this time, the coil spring 165 elastically deforms and absorbs the reaction force. The weight 163 is then returned by the restoring force of the coil spring 165 to the reaction force transmitting position in which the reaction force was transmitted from the impact bolt 145 to the weight 163. However, when the striker 143 performs the next striking movement on the impact bolt 145 in a midway region by the time the weight 163 is returned to the reaction force transmitting position after the weight 163 is caused to move rearward by receiving the reaction force, the weight 163 and the coil spring 165 do not function properly.

Therefore, in this embodiment, the resonance frequency defined under the assumption that the weight 163 and the coil spring 165 are models of the spring mass system is set over half of the frequency of striking which is performed on the impact bolt 145 by the striker 143. In other words, the spring constant of the coil spring 165 is set such that the resonance period defined under the assumption that the weight 163 and the coil spring 165 are models of the spring mass system is set below half of the period of striking which is performed on the impact bolt 145 by the striker 143. In this manner, the weight 163 and the coil spring 165 can function properly, Specifically, the weight 163 and the coil spring 165 can reliably absorb the impact for each stroke of the striker 143.

The condition to be satisfied by the spring constant of the coil spring 165 in order for the weight 163 and the coil spring 165 to properly function for each stroke of the striker 143 is mathematically obtained as follows:

$$fo=1/To, \quad (1)$$

wherein fo [Hz] and To [s] are the striking frequency and the striking period of the striker 143, respectively.

Further, under the assumption that the weight 163 and the coil spring 165 are models of the spring mass system, the angular velocity ω during resonance of the spring-mass system models is obtained as follows:

$$\omega=\sqrt{(k/m)}=2\pi/T \text{ [rad/s]}, \quad (2)$$

wherein the mass of the weight 163 is taken as m[kg], the spring constant of the coil spring 165 is k[N/m], and the resonance frequency of the spring-mass system models is T[s].

Further, from the relationship between the resonance period of the spring-mass system models and the striking period of the sinker 143, $$T/2<To \quad (3)$$

Substituting $T=2\pi\sqrt{(m/k)}$ from Equation (2) into Equation (3) yields:

$$\pi\sqrt{(m/k)}<To \quad (4)$$

Squaring Equation (4), wherein the striking period To, the spring constant k and the mass m are all positive numbers, $$\pi^2 m/k<To^2 \; k>\pi^2 m/To^2=\pi^2 mfo^2 \quad (5)$$

Therefore, the condition to be satisfied by the spring constant of the coil spring 165 is:

$$k>\pi^2 mfo^2 \quad (6)$$

By setting the spring constant of the coil spring 165 to such a value that satisfies Equation (6), it can be constructed such that the weight 163 and the coil spring 165 function properly.

Further, in this embodiment, the viscoelastic member in the form of the rubber ring 164 is disposed between the cylindrical weight 163 and the coil spring 165 and serves to absorb a stress wave of the cylindrical weight 163. The mass of the rubber ring 164 is extremely smaller than the mass of the cylindrical weight 163. Further, although the rubber ring 164 deforms by the stress wave of the cylindrical weight 163, the amount of such deformation is extremely smaller than the amount of deformation of the coil spring 165. Therefore, in setting the above-described spring constant of the coil spring 165, the rubber ring 164 can be considered as part of the weight 163 and practically has little adverse effect.

Further, in the hammer drill 101 according to this embodiment a dynamic vibration reducer, which is not shown, may be mounted in the body 103 and can be used together with the impact absorbing mechanism having the weight 163 and the coil spring 165. In this case, a passive vibration reducing function can be performed on periodic vibration which is caused in the body 103 in the longitudinal direction of the body 103 during hammering operation. Thus, the vibration of the body 103 can be effectively reduced. Further, the pressure within the crank chamber that houses the crank mechanism fluctuates when the hammer drill 101 is driven. Therefore, it can be constructed such that the fluctuating pressure is introduced into the dynamic vibration reducer and a weight forming a component part of the dynamic vibration reducer is actively driven. In other words, a forced vibration method can be employed. In this case, the dynamic vibration reducer functions as an effective vibration reducing mechanism by forced vibration of the weight. Thus, the vibration caused in the body 103 during hammering operation can be further effectively reduced.

In the above-described embodiment, the hammer drill 101 was described as a representative example of the impact power tool. However, the present invention can also be applied to a hammer. Further, in the above embodiment, the reaction force was described as being transmitted via a path from the impact bolt 145 to the cylindrical weight 163, it may be configured such that the reaction force is transmitted via a path from the hammer bit 119 to the cylindrical weight 163. Further, the cylindrical weight 163 may have a shape other than a cylindrical shape.

Further, in the above embodiment, the crank mechanism was described as being used as the motion converting mechanism 113 for converting the rotating output of the driving motor 111 to linear motion in order to linearly drive the hammer bit 119. However, the motion converting mechanism is not limited to the crank mechanism, but, for example, a swash plate that axially swings may be utilized as the motion converting mechanism. Further, in the above embodiment, the stopper 169 serves to prevent forward movement of the cylindrical weight 163 so that the biasing force of the coil spring 165 is controlled to be prevented from substantially acting forward beyond the striking position. However, instead of provision of control by the stopper 169, it may be changed in construction such that, for example, the coil spring 165 is disposed in a free state in which an initial load is not applied. Further, from the viewpoint of cushioning the reaction force received from the workpiece during hammering operation, the rubber ring 164 may be disposed between the coil spring 165 and the spring receiving ring 167.

DESCRIPTION OF NUMERALS

101 hammer drill (impact power tool)
103 body (tool body)
105 motor housing
107 gear housing
109 handgrip
109*a* pivot
109*b* elastic spring
111 driving motor
113 motion converting mechanism (driving mechanism)
115 striking mechanism
117 power transmitting mechanics
119 hammer bit (hammer actuating member)
119*a* head edge portion
121 driving gear
123 driven gear
125 crank plate
126 eccentric shaft
127 crank arm
128 connecting shaft
129 piston
131 transmission gear
133 transmission shaft
134 small bevel gear
135 large bevel gear
137 tool holder
141 cylinder
141*a* air chamber
143 striker
145 impact bolt (hammer actuating member)
145*a* large-diameter portion
145*b* small-diameter portion
145*c* tapered portion
151 positioning member
153 rubber ring
155 front metal washer (intervening member)
157 metal washer
159 spacer
163 cylindrical weight (weight)
164 rubber ring (viscoelastic member)
165 coil spring (elastic element)
167 spring receiving ring
169 stopper

We claim

1. An impact power tool comprising:

a tool body, a hammer actuating member that is disposed in a tip end region of the tool body and performs a predetermined hammering operation on a workpiece by reciprocating in its axial direction, a striker that performs a striking movement on the hammer actuating member by reciprocating in the longitudinal direction of the tool body, a weight configured such that a first portion of a reaction force is transmitted from the hammer actuating member to the weight either by:

(1) direct contact between the hammer actuating member and the weight, or (2) via an intervening member made of hard metal, the intervening member being configured to transmit the first portion of the reaction force from the hammer actuating member to the weight, a first elastic element configured such that a second portion of the reaction force is transmitted from the hammer actuating member to the first elastic member either by:

(1) direct contact between the hammer actuating member and the first elastic element, or (2) via an intervening member made of hard metal the intervening member being configured to transmit the second portion of the reaction force from the hammer actuating member to the first elastic element, and a second elastic element that elastically deforms when the weight is caused to move rearward from the reaction force transmitting position by the reaction force transmitted to the weight and pushes the second elastic element, thereby absorbing the reaction force, wherein the mass of the weight is set to about 40% or more of the mass of the striker, and the first portion of the reaction force is greater than the second portion of the reaction force.

2. The impact power tool as defined in claim 1, wherein the mass of the weight is selected from about 40% to about 200% of the mass of the striker.

3. The impact power tool as defined in claim 1, wherein the mass of the weight is selected from about 80% to about 200% of the mass of the striker.

4. The impact power tool as defined in claim 1, wherein a resonance frequency, where the weight and the second elastic element are models of a spring mass system, is set over half of the period of striking, the striking being performed on the hammer actuating member by the striker.

5. The impact power tool as defined in claim 4, wherein a viscoelastic member is disposed between the weight and the second elastic element and serves to absorb a stress wave of the weight when the reaction force of the hammer actuating member is transmitted to the weight.

6. The impact power tool as defined in claim 1, wherein a viscoelastic member is disposed between the weight and the second elastic element to absorb a stress wave of the weight when the reaction force of the hammer actuating member is transmitted to the weight.

7. The impact power tool as defined in claim 1, wherein the intervening member is a washer.

8. impact power tool as defined in claim 1, wherein the weight extends from an outer peripheral region of a positioning member to an outer front region of a cylinder.

9. An impact power tool comprising:

a tool body, a hammer actuating member that is disposed in a tip end region of the tool body and performs a predetermined hammering operation on a workpiece by reciprocating in its axial direction, a striker that performs a striking movement on the hammer actuating member by reciprocating in the longitudinal direction of the tool body, a weight configured so that a first portion of a reaction force is transmitted from the hammer actuating member in a reaction force transmitting position, a first elastic element configured so that a second portion of the reaction force is transmitted from the hammer actuating member in the reaction force transmitting position, and a second elastic element that elastically deforms when the weight is caused to move rearward from the reaction force transmitting position by the reaction force transmitted to the weight and pushes the second elastic element, thereby absorbing the reaction force, wherein a resonance frequency, where the weight and the second elastic element are models of a spring mass system, is set over half of the period of striking, the striking being performed on the hammer actuating member by the striker, wherein, in the reaction force transmitting position, the weight and the first elastic element are placed in direct contact with the hammer actuating member or placed in contact with the hammer actuating member via an intervening member made of hard metal when the hammer actuating member performs a hammering operation on the workpiece, the intervening member transmitting the first portion of the reaction force to the weight and transmitting the second portion of the reaction force to the first elastic element, and wherein the first portion of the reaction force is greater than the second reaction force.

* * * * *